US010265723B2

(12) United States Patent
Kikuchi et al.

(10) Patent No.: US 10,265,723 B2
(45) Date of Patent: Apr. 23, 2019

(54) COATING NOZZLE, COATING APPARATUS, AND COATING METHOD USING THE SAME

(71) Applicant: HONDA MOTOR CO., LTD., Tokyo (JP)

(72) Inventors: Takashi Kikuchi, Tochigi (JP); Koichi Ikebukuro, Tochigi (JP); Masaki Shigekura, Tochigi (JP); Junichi Fukuno, Tochigi (JP); Osamu Yashima, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 32 days.

(21) Appl. No.: 15/451,628

(22) Filed: Mar. 7, 2017

(65) Prior Publication Data

US 2017/0282211 A1 Oct. 5, 2017

(30) Foreign Application Priority Data

Mar. 29, 2016 (JP) ..... 2016-065661

(51) Int. Cl.
*B05D 1/02* (2006.01)
*B05B 1/30* (2006.01)

(52) U.S. Cl.
CPC . *B05D 1/02* (2013.01); *B05B 1/30* (2013.01)

(58) Field of Classification Search
None
See application file for complete search history.

(56) References Cited

U.S. PATENT DOCUMENTS 6,962,298 B1 * 11/2005 Martin ..... A61H 9/005 239/124
2004/0056123 A1 * 3/2004 Douglas ..... B05B 1/1654 239/587.4

FOREIGN PATENT DOCUMENTS

| | | |
|---|---|---|
| CN | 102451801 | 5/2012 |
| JP | 2013-103302 | 5/2013 |
| JP | 2013-111512 | 6/2013 |

OTHER PUBLICATIONS

Chinese Office Action dated Oct. 10, 2018, 6 pages.

* cited by examiner

*Primary Examiner* — Nathan T Leong
(74) *Attorney, Agent, or Firm* — Rankin, Hill & Clark LLP

(57) ABSTRACT

Provided are a coating apparatus which coats an article using a plurality of coating nozzles and is capable of performing the coating without restriction of the posture of the article, a coating nozzle used for the same, and a coating method. A coating apparatus includes: a first air jet port 20; a plurality of coating material jet ports 22 dispersedly disposed in the periphery of the first air jet port 20 across the whole circumference; and a plurality of second air jet ports 24 dispersedly disposed in the periphery of the coating material jet ports 22 across the whole circumference. The coating apparatus includes a plurality of coating nozzles 18 each of which performs jetting via a circulating passage formed along the dispersing arrangement of the second air jet ports 24. A controlling unit 34 independently controls individual adjusting units of the plurality of coating nozzles 18.

6 Claims, 3 Drawing Sheets

COATING NOZZLE, COATING APPARATUS, AND COATING METHOD USING THE SAME

BACKGROUND OF THE INVENTION

Field of the Invention

The present invention relates to a coating apparatus which sprays coating material to perform coating, a coating nozzle used for the coating apparatus, and a coating method using the same.

Description of the Related Art

Conventionally, for example, in a coating step on a production line of a factory, coating an article to be coated is performed using a coating robot system or the like. From among such coating robot systems, for example, Japanese Patent Laid-Open No. 2013-103302 (hereinafter referred to as Patent Literature 1) discloses one which comprises a spray gun unit having a plurality of spray guns fixed onto a supporting body. With this spray gun unit, by setting distances between the plurality of spray guns to be changeable, for example, even the case where pitches between a plurality of articles to be coated are changed can be easily handled. Japanese Patent Laid-Open No. 2013-111512 (hereinafter referred to as Patent Literature 2) discloses, although for a thin film forming apparatus, a technology in which an arrangement distance between adjacent spray nozzles is set to be an optimized value when a thin film is formed using a plurality of spray nozzles.

However, the coating apparatuses disclosed in Patent Literature 1 and Patent Literature 2 only control the distance between the spray guns or between the spray nozzles to handle the case where conditions of the article to be coated are changed. In other words, it is difficult to handle various changes in posture of the article to be coated without control of spraying situations of the coating material.

The present invention has been made in view of the aforementioned conventional problem, and an object thereof is to provide a coating apparatus which coats an article to be coated using a plurality of coating nozzles and is capable of performing the coating without restriction due to the posture of the article to be coated, a coating nozzle used for the same, and a coating method.

SUMMARY OF THE INVENTION

There is provided a coating nozzle of the present invention, comprising a nozzle tip part in which a first air jet port, a plurality of coating material jet ports dispersedly disposed in an annular region outside the first air jet port, and a plurality of second air jet ports dispersedly disposed in an annular region outside the plurality of coating material jet ports are formed, wherein a second air feed passage which feeds air to an outside of the coating nozzle through the plurality of second air jet ports includes an annular path which is disposed inside the coating nozzle and communicates with the outside via the plurality of second air jet ports.

The coating nozzle of the present invention takes the configuration in which the second air feed passage which feeds air to the second air jet ports that are positioned outward out of the first air jet port and the second air jet ports that are positioned inward and outward of the coating material jet ports, respectively, includes the annular path which is disposed inside the nozzle tip part and communicates with the outside via the plurality of second air jet ports.

Hence, the air jetted from the second air jet ports can form a rotational flow. This consequently improves shear force and atomizes the jetted coating material, which enables uniform coating with less unevenness.

In the coating nozzle of the present invention, it is preferable that a coating material feed passage which feeds coating material to the outside of the coating nozzle through the plurality of coating material jet ports includes an annular path which is disposed inside the coating nozzle and communicates with the outside via the plurality of coating material jet ports. With this configuration, similarly to the air jetted from the second air jet ports, the coating material jetted from the coating material jet ports can also form a rotational flow. This makes fine particles of the coating material with shear force, which enables uniform coating with less unevenness.

In the coating nozzle of the present invention, it is preferable that a first air feed passage which feeds air to the outside of the coating nozzle through the first air jet port forms a path which extends from a nozzle rear end part toward the nozzle tip part and communicates with the outside of the first air jet port, the second air feed passage includes an extending teed passage extending from the nozzle rear end part to the annular path, the coating material feed passage includes an extending feed passage extending from the nozzle rear end part to the annular path, and the extending feed passage of the second air feed passage and the extending feed passage of the coating material feed passage are disposed in a periphery of the first air feed passage with their positions in a circumferential direction displaced from each other. With such a configuration, the extending feed passage of the second air feed passage and the extending feed passage of the coating material feed passage do not interfere with each other. This improves space efficiency and contributes downsizing, compared with the case where they are provided on the same side.

There is provided a coating apparatus of the present invention, having a plurality of coating nozzles of the present invention arranged, the apparatus comprising: for each of the plurality of coating nozzles, a first adjusting unit which adjusts a jet quantity of air jetted from the first air jet port to the outside of the coating nozzle; for each of the plurality of coating nozzles, a second adjusting unit which adjusts a jet quantity of air jetted from the second air jet ports to the outside of the coating nozzle; and a controlling unit which independently controls the first adjusting unit and the second adjusting unit.

The coating apparatus of the present invention is a coating apparatus comprising the plurality of coating nozzles of the present invention in the state where they are arranged, the apparatus comprising: for each of the plurality of coating nozzles, the first adjusting unit which adjusts the jet quantity of air jetted from the first air jet port; and the second adjusting unit which adjusts the jet quantity of air jetted from the second air jet ports. Hence, the jet quantities of air jetted from the first and second air jet ports can be separately adjusted. Moreover, by having the controlling unit which independently controls the first adjusting unit and the second adjusting unit, the first adjusting unit and the second adjusting unit can be independently controlled. Hence, patterns (jet quantities and areas) of the coating material jetted from the coating nozzles can be freely controlled, which enables coating without restrictions due to the roughness and angle of an article to be coated.

In the coating apparatus of the present invention, it is preferable that the controlling unit controls the first adjusting unit and the second adjusting unit of the plurality of coating nozzles independently for each coating nozzle. With such a configuration, the first adjusting units and the second adjusting units of the plurality of coating nozzles which arranged can be controlled independently for each coating nozzle, which enables the patterns of the coating material jetted from the coating nozzles to be separately controlled.

There is provided a coating method of the present invention, using the coating apparatus of the present invention, the method comprising controlling a jest state of the coating material jetted from the coating material jet ports by adjusting a jet state of the air jetted from the first air jet port and a jet state of the air jetted from the second air jet ports.

The coating method of the present invention is a coating method using the coating apparatus of the present invention, and the jet states of the air jetted from the first air jet port and the second air jet ports of each coating nozzle are independently controlled. Thereby, coating can be performed while adjusting the jet states of the coating material without restriction due to the posture of the article to be coated.

DETAILED DESCRIPTION OF THE PREFERRED EMBODIMENTS

Hereafter, a coating nozzle, a coating apparatus and a coating method of the present invention are described in detail with reference to the appended drawings.

Figure 1:
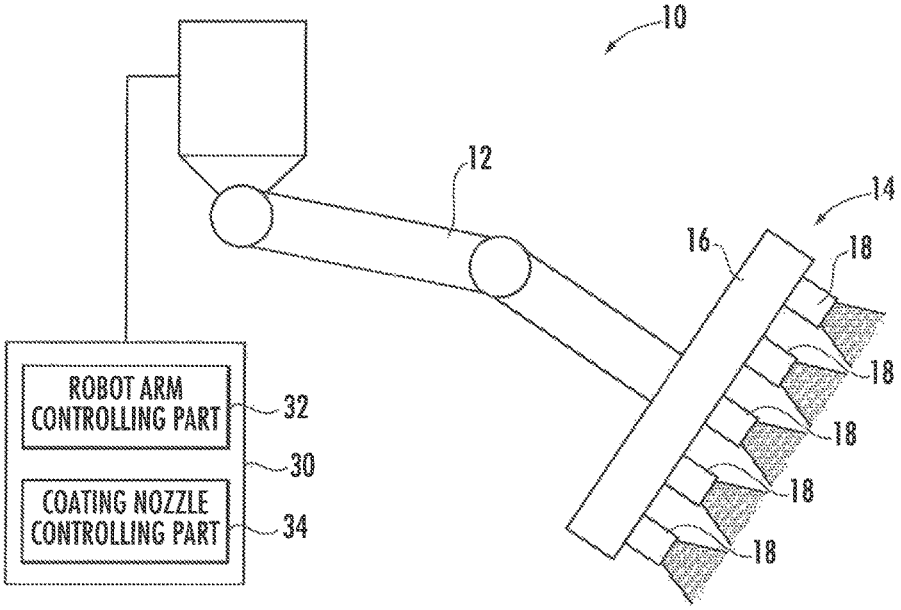
FIG. 1 is a perspective view schematically illustrating the essential part of a coating apparatus according to an embodiment.

FIG. 1 is a diagram conceptually showing the essential part of a coating apparatus of the present embodiment. A coating apparatus 10 shown in FIG. 1 includes a robot arm 12 whose distal end can be moved in the upward and downward direction and the horizontal direction, and which enables its rotary operation, and a coating nozzle unit 14 is attached to the end part of the robot arm 12. The coating nozzle unit 14 includes a plurality of (five) coating nozzles 18 on an installation stage 16, and the five coating nozzles 18 are arranged into a straight line with same intervals on the surface of the installation stage 16. The number and arrangement mode of the coating nozzles 18 may be variously changed. For example, six coating nozzles 18 may be arranged on the same annulus with same intervals. By the robot arm 12 enabling the aforementioned operations, the coating nozzle unit 14 can be freely controlled in its angle and position by the movements of the robot arm 12. Since any known robot arm can be employed as the robot arm, description of the configuration of the robot arm is omitted.

The coating apparatus 10 includes a controlling part 30 which controls the robot arm 12 and the coating nozzle unit 14. The controlling part 30 has a robot arm controlling part 32 which controls operation of the robot arm 12, and a coating nozzle controlling part (controlling unit) 34 which controls the coating material jet patterns of each coating nozzles 18 of the coating nozzle unit 14 and turning-on and turning-off of the coating material jetting.

Figure 2:
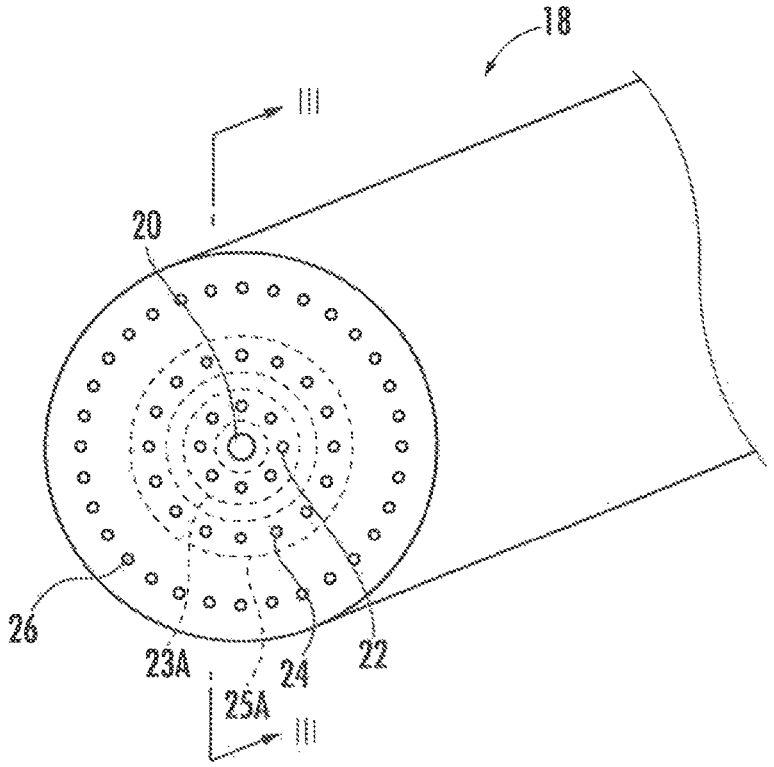
FIG. 2 is a perspective view exemplarily illustrating a coating nozzle according to the present embodiment.

The coating nozzle 18 provided in the coating nozzle unit 14 is described. As shown in FIG. 2, in a substantially circular nozzle tip part of the coating nozzle 18, a first air jet port 20 is provided at the center part. Moreover, in an annular region outside the first air jet port 20, a plurality of coating material jet ports 22 are dispersedly disposed in the circumferential direction, for example, so as to have rotational symmetry or regularly. Furthermore, in an annular region outside the plurality of coating material jet ports 22, a plurality of second air jet ports 24 are dispersedly disposed in the circumferential direction, for example, so as to have rotational symmetry or regularly. More specifically, in a tip part of the coating nozzle 18, a hub member 19 mentioned later in which the first air jet port 20 and the coating material jet ports 22 are provided is fitted in the state where its tip is exposed from the coating nozzle 18 (see FIG. 3). Notably, in coating, the coating nozzle 18 is not used to be rotated but used in the state of standing still on the installation stage 16. The numbers, diameters (or opening sectional areas), and arrangement modes of the coating material jet ports 22 and the second air jet ports 24 may be variously changed. For example, the plurality of coating material jet ports 22 may be irregularly disposed on the same annulus. Likewise, the plurality of second air jet ports 24 may be irregularly disposed on the same annulus.

Figure 3:
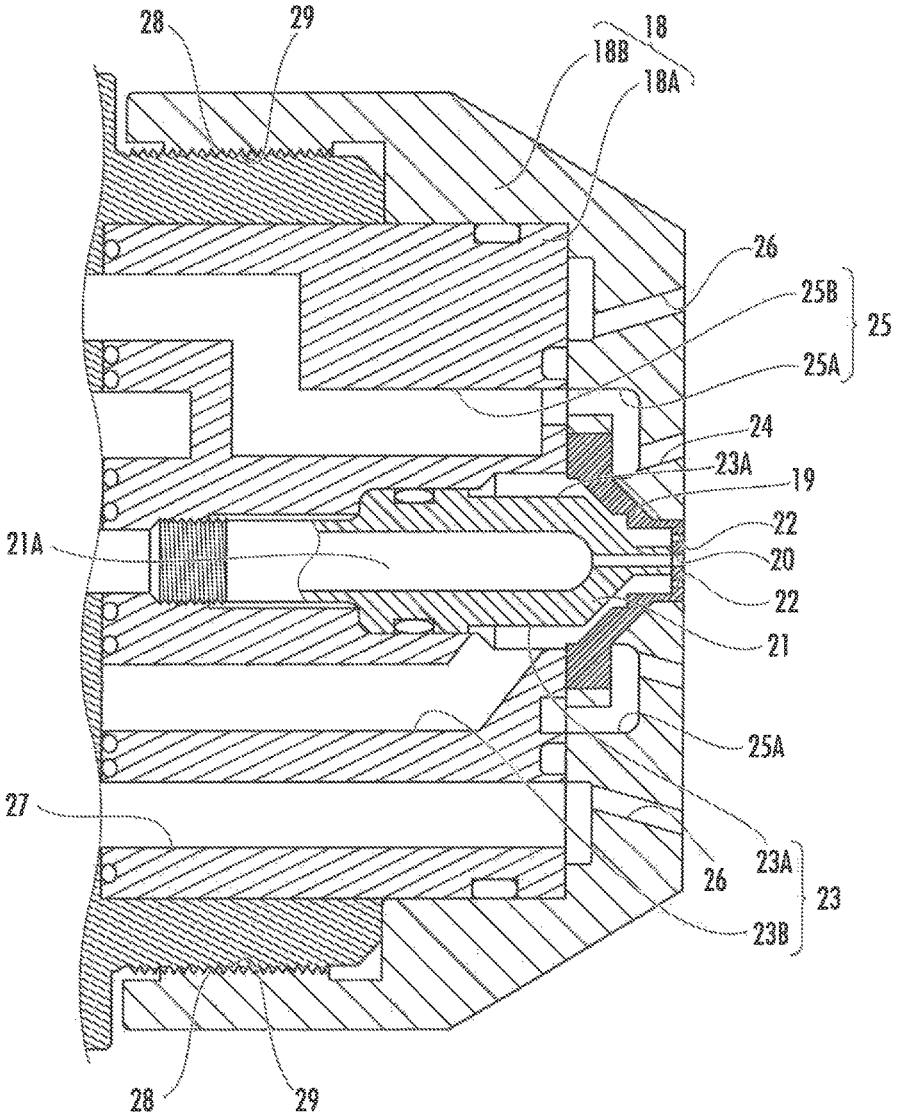
FIG. 3 is a cross-sectional view of the coating nozzle according to the present embodiment.

FIG. 3 is a cross-sectional view of the coating nozzle 18 taken along the III-III line in FIG. 2. The coating nozzle 18 includes a nozzle main body 18A and a housing 18B covering the nozzle main body 18A. In the nozzle main body 18A, a first air feed passage 21A, a coating material feed passage 23 and a second air feed passage 25 are disposed. The first air feed passage 21A and the second air feed passage 25 are connected to a not-shown air feed source, and the coating material feed passage 23 is connected to a not-shown coating material feed source. As shown in FIG. 3, the first air feed passage 21A is formed inside a tubular member 21 fixed inside the nozzle main body 18A.

Into the housing 18B, as mentioned above and as shown in FIG. 2, the hub member 19 in which the single first air jet port 20 is formed in the center part, and the plurality of coating material jet ports 22 are formed in an annular region outside the first air jet port 20, is fitted (see FIG. 3). The plurality of second air jet ports 24 are formed in an annular region outside the plurality of coating material jet ports 22. The first air feed passage 21A communicates with the first air jet port 20, the coating material feed passage 23 communicates with the plurality of coating material jet ports 22, and the second air feed passage 25 communicates with the plurality of second air jet ports 24. In the nozzle main body 18A, a male screw 28 is formed, and in the housing 18B, a female screw 29 is formed. The nozzle main body 18A and the housing 18B are fixed to each other by screw-fitting with the male screw 28 and the female screw 29.

As shown in FIG. 3, the first air feed passage 21A extends from a nozzle rear end part toward the nozzle tip part, and forms a linear path communicating with the outside of the first air jet port 20. In other words, air from the air feed source flows in the first air feed passage 21A, and is jetted from the first air jet port 20 to the outside. In coating, control is performed by the coating nozzle controlling part 34 such that the air is jetted from the first air jet port 20.

The coating material teed passage 23 which feeds the coating material outside the coating nozzle 18 through the plurality of coating material jet ports 22, includes an annular path 23A which is disposed inside the nozzle tip part and communicates with the outside of the plurality of coating material jet ports 22. The annular path 23A is a space formed between the hub member 19 and the tubular member 21 in the occasion of fitting of the first air jet port 20 of the hub member 19 so as to meet the first air feed passage 21A of the tubular member 21, and communicates with an extending feed passage 23B extending from the nozzle rear end part to the annular path 23A. In other words, the annular path 23A exists at an opposing position to the annular region, outside the first air jet port 20, in which the plurality of coating material jet ports 22 are formed. The coating material from the coating material feed source flows in the extending feed passage 23B, and when reaching the annular path 23A, is jetted from the coating material jet ports 22 while circulating in the annular path 23A. As a result, the coating material jetted from the dispersedly disposed plurality of coating material jet ports 22 forms a rotational flow, which improves shear force and contributes to form fine particles of the coating material.

The second air feed passage 25 which feeds air outside the coating nozzle 18 through the plurality of second air jet ports 24 includes an annular path 25A which is disposed inside the nozzle tip part and communicates with the outside of the plurality of second air jet ports 24. The annular path 25A communicates with an extending feed passage 25B extending from the nozzle rear end part to the annular path 25A. In other words, the annular path 25A exists at an opposing position to the annular region, outside the coating material jet ports 22, in which the plurality of second air jet ports 24 are formed. Air from the air feed source flows in the extending feed passage 25B, and when reaching the annular path 25A, is jetted from the second air jet ports 24 while circulating in the annular path 25A. As a result, the air jetted from the dispersedly disposed plurality of second air jet ports 24 forms a rotational flow, which improves shear force and contributes to form fine particles of the coating material. In coating, control is performed by the coating nozzle controlling part 34 such that the air is jetted from the second air jet ports 24.

The air jetted from the first air jet port 20 and the coating material jetted from the coating material jet ports 22 are adjusted in respective directions so as to be jetted in the normal direction of the tip plane of the coating nozzle 18. Therefore, the air jetted from the first air jet port 20 and the coating material jetted from the coating material jet ports 22 travel straight in the normal direction immediately after jetted from the respective jet ports. On the contrary, the second air jet ports 24 are inclined outward so as to go far from the normal direction of the tip plane of the coating nozzle 18, as being closer to the tip plane. The air jetted from the second air jet ports 24 travels, while forming a rotational flow, in an outwardly inclined direction relative to the normal direction of the tip plane of the coating nozzle 18. In this case, an inclination angle θ of the second air jet port 24 relative to the normal direction of the tip plane of the coating nozzle 18 is preferably $0° < \theta \leq 60°$ (more preferably, $5° \leq \theta \leq 30°$).

The extending feed passage 23B of the coating material feed passage 23 and the extending teed passage 25B of the second air feed passage 25 are disposed in the periphery of the first air feed passage 21A. Here, as shown in FIG. 3, they are preferably disposed with their positions in the circumferential direction displaced from each other. Such a configuration improves space efficiency and contributes downsizing, compared with the case where they are provided on the same side, without interference between the extending feed passage 25B of the second air feed passage 25 and the extending feed passage 23B of the coating material feed passage 23.

To the first air feed passage 21A and the second air feed passage 25, air is fed from the air feed source. In the first air feed passage 21A, a first adjusting unit (not shown) which adjusts a jet quantity of the air from the first air jet port 20 is provided. In the second air feed passage 25, a second adjusting unit (not shown) which adjusts a jet quantity of the air from the second air jet ports 24 is provided. Each adjusting unit electrically adjusts the flow rate of the air from the air feed source in response to an instruction from the coating nozzle controlling part 34, and a magnetic valve or the like can be used. In other words, by the adjusting units respectively provided in the first air feed passage 21A and the second air feed passage 25, the flow rates of the air fed to each of the air feed passages are adjusted, and the strength or turning-on and turning-off of the air jetted from each air jet port can be independently adjusted.

With the above configuration, when coating, air is jetted from the first air jet port 20 and the second air jet ports 24, and the coating material is jetted from the coating material jet ports 22. The coating material jetted from the plurality of coating material jet ports 22 is made into fine particles by the air jetted from the first air jet port 20. Since the coating material jet ports 22 are disposed in the periphery of the first air jet port 20, and the coating material is attracted thereto by negative pressure of the air jetted from the first air jet port 20, the air jetted from the first air jet port 20 can be 100% brought into contact with the coating material. By setting the jet speed of the air jetted from the first air jet port 20 to be a faster speed than that of the coating material, the fine particles can be promoted to be formed.

As mentioned above, since the air jetted from the second air jet ports 24 spreads outward while forming a rotational flow, the coating material made into fine particles with the air jetted from the first air jet port 20 as mentioned above spreads and travels outward. The area of this spreading can be controlled by the strength of the air jetted from the second air jet ports 24. Specifically, when the air jetted from the second air jet ports 24 is made strong, the coating material spreads wide, and when it is made weak, the spreading becomes small. Accordingly, by adjusting the strength of the air jetted from the second air jet ports 24, the area of the coating material spreading can be changed.

While one coating nozzle 18 has been described as above, the coating apparatus 10 of the present embodiment comprises the five coating nozzles 18. The adjusting units of the individual coating nozzles 18 are independently controlled by the coating nozzle controlling part (controlling unit) 34. Namely, the jet patterns of the coating material from the coating nozzles 18 can be made different from one another for the individual coating nozzles 18 by independently controlling the adjusting units with the coating nozzle controlling part 34. The patterns of jet from the five coating nozzles 18 can be variously set. Accordingly, the jet state of the air jetted from the first air jet port 20 and the jet state of the air jetted from the second air jet ports 24 can be adjusted, thereby, to perform coating while controlling the jet state of the coating material jetted from the coating material jet ports, which enables coating without restrictions due to the roughness and angle of an article to be coated.

As shown in FIG. 2, the shape of the coating material jet port 22 is a hole shape, and the plurality of them are provided. This can make the liquid column of coating material thin and enables efficient atomization thereof with the air. Coating material particles obtained by atomization with the air jetted from the first air jet port 22 depart from the flow of the air, and immediately, can be carried on the flow of the air jetted from the second air jet ports 24. Hence, atomization can be performed without disturbing a variable nozzle pattern with the second air jet ports 24.

As shown in FIG. 2 and FIG. 3, furthermore, in the coating nozzle 18, a plurality of third air jet ports 26 dispersedly disposed in the circumferential direction, for example, so as to have rotational symmetry or regularly are provided in an annular region outside the second air jet ports 24. The plurality of third air jet ports 26 may be irregularly disposed on the same annulus. The third air jet ports 26 communicate with a third air feed passage 27. The third air feed passage 27 is connected to a not-shown air feed source. Air from the air feed source is jetted from the third air jet ports 26 via the third air feed passage 27. The air jetted from the third air jet ports 26 enables a flight pattern of the coating material particles to be further controlled. Similarly to the second air jet ports 24, the third air jet ports 26 are inclined outward so as to go far from the normal direction of the tip plane of the coating nozzle 18 as being close to the tip plane. In this case, an inclination angle θ of the third air jet port 26 relative to the normal direction of the tip plane of the coating nozzle 18 is preferably $0° < \theta \leq 60°$ (more preferably, $5° \leq \theta \leq 30°$).

In the coating apparatus 10 of the present embodiment, the plurality of coating nozzles 18 described above are used in the state of the coating nozzle unit 14 in which they are provided on the installation stage 16, and the coating nozzle unit 14 is mounted onto the tip of the robot arm 12. Accordingly, in coating an article to be coated, the coating nozzle unit 14 can be freely changed in its posture by the robot arm 12. Moreover, in each coating nozzle 18, the jet state of the air jetted from the first air jet port 20 and the jet state of the air jetted from the second air jet ports 24 are independently controlled. Accordingly, by independently controlling the jet states of the coating material in the individual coating nozzles along with the posture control by means of the robot arm 12, simultaneous coating in a wide range can be performed without restriction due to the posture of the article to be coated. Moreover, by turning on and off the jets from the individual coating nozzles 18, the pattern can be changed in the coating apparatus 10 as a whole. Moreover, the ejecting quantities of each of the coating nozzles can be set to be constant, which can secure coating quality to be constant regardless of the pattern or the ejecting quantity.

While in the coating apparatus 10 of the present embodiment, the plurality of coating material jet ports 22 are provided, increase of the jet quantity of the coating material can be realized by further increasing the coating material jet ports.

REFERENCE SIGNS LIST

10 Coating apparatus
12 Robot arm
14 Coating nozzle unit
18 Coating nozzle
20 First air jet port
21 Tubular member
21A First air feed passage
22 Coating material jet port
23 Coating material feed passage
24 Second air jet port
25 Second air feed passage
26 Third air jet port
27 Third air feed passage
30 Controlling part
32 Robot arm controlling part
34 Coating nozzle controlling part (controlling unit)

What is claimed is:

1. A coating nozzle comprising a nozzle tip part formed with a first air jet port, a first air feed passage which feeds air to outside of the coating nozzle through the first air jet port, a plurality of coating material jet ports dispersedly disposed in an annular region outside the first air jet port, a coating material feed passage which feeds coating material to the outside of the coating nozzle through the plurality of coating material jets, a plurality of second air jet ports dispersedly disposed in an annular region outside the plurality of coating material jet ports, and a second air feed passage which feeds air to the outside of the coating nozzle through the plurality of second air jet ports, wherein the second air feed passage includes an annular path which is disposed inside the coating nozzle and communicates with the outside of the coating nozzle via the plurality of second air jet ports, and the coating material feed passage is separated from the first air feed passage and the second air feed passage.

2. The coating nozzle according to claim 1, wherein the coating material feed passage includes an annular path which is disposed inside the coating nozzle and communicates with the outside of the coating nozzle via the plurality of coating material jet ports.

3. The coating nozzle according to claim 2, wherein the first air feed passage forms a path which extends from a nozzle rear end part of the coating nozzle toward the nozzle tip part and communicates with the outside of the coating nozzle via the first air jet port, the second air feed passage includes a first extending feed passage extending from the nozzle rear end part to the annular path of the second air feed passage, the coating material feed passage includes a second extending feed passage extending from the nozzle rear end part to the annular path of the coating material feed passage, and the first extending feed passage of the second air feed passage and the second extending feed passage of the coating material feed passage are disposed in a periphery of the first air feed passage with their positions in a circumferential direction displaced from each other.

4. A coating apparatus having a plurality of coating nozzles according to claim 1 arranged, the apparatus comprising:

for each of the plurality of coating nozzles, a first adjusting unit which adjusts a jet quantity of air jetted from the first air jet port to the outside of the coating nozzle;

for each of the plurality of coating nozzles, a second adjusting unit which adjusts a jet quantity of air jetted from the second air jet ports to the outside of the coating nozzle; and a controlling unit which independently controls the first adjusting unit and the second adjusting unit.

5. The coating apparatus according to claim 4, wherein the controlling unit controls the first adjusting unit and the second adjusting unit of the plurality of coating nozzles independently for each coating nozzle.

6. A coating method using the coating apparatus according to claim 4, the method comprising controlling a jet state of coating material jetted from the coating material jet ports by adjusting a jet state of the air jetted from the first air jet port and a jet state of the air jetted from the second air jet ports.

* * * * *